US007188739B1

(12) United States Patent
Raile

(10) Patent No.: US 7,188,739 B1
(45) Date of Patent: Mar. 13, 2007

(54) EYEWEAR CASE AND DISPLAY METHOD

(75) Inventor: Bruce Raile, Park City, UT (US)

(73) Assignee: Sun Optics, Inc., Salt Lake City, UT (US)

( * ) Notice: Subject to any disclaimer, the term of this patent is extended or adjusted under 35 U.S.C. 154(b) by 0 days.

(21) Appl. No.: 10/360,264

(22) Filed: Feb. 6, 2003

Related U.S. Application Data

(60) Provisional application No. 60/433,724, filed on Dec. 13, 2002.

(51) Int. Cl.
*A47F 7/02* (2006.01)

(52) U.S. Cl. ..... 211/85.1

(58) Field of Classification Search ..... 211/85.1; 248/902; 206/5, 6
See application file for complete search history.

(56) References Cited

U.S. PATENT DOCUMENTS

| | | | | |
|---|---|---|---|---|
| 246,460 | A | | 8/1881 | Chase et al. |
| 1,092,156 | A | | 4/1914 | Mathis |
| 2,606,708 | A | | 8/1952 | Irvan |
| 2,713,947 | A | | 7/1955 | Foster |
| 2,735,597 | A | | 2/1956 | Treleven |
| 2,747,760 | A | * | 5/1956 | Jacobson ..... 220/475 |
| 2,809,766 | A | | 10/1957 | Anderson |
| 2,816,666 | A | | 12/1957 | Nadel |
| RE24,571 | E | | 11/1958 | Nadel |
| 2,936,897 | A | | 5/1960 | Bloch |
| 2,966,271 | A | | 12/1960 | Nadel |
| 3,333,709 | A | | 8/1967 | Leblanc et al. |
| D208,469 | S | | 9/1967 | Parker |
| 3,357,568 | A | | 12/1967 | Leblanc et al. |
| 3,593,856 | A | | 7/1971 | Zander |
| 3,817,392 | A | * | 6/1974 | Bloch ..... 211/85.1 |
| 3,857,482 | A | | 12/1974 | Shelton |
| 3,866,800 | A | | 2/1975 | Schmitt |
| 4,000,810 | A | | 1/1977 | Leblanc |
| 4,204,602 | A | | 5/1980 | Dunchock |
| D267,992 | S | | 2/1983 | Shelton |
| D275,160 | S | | 8/1984 | Shelton |
| D275,161 | S | | 8/1984 | Shelton |
| 4,572,366 | A | | 2/1986 | Carson |
| 4,614,272 | A | | 9/1986 | Shelton et al. |
| D286,462 | S | | 11/1986 | Sender et al. |
| 4,715,575 | A | | 12/1987 | Kamerer |

(Continued)

OTHER PUBLICATIONS

Pocket Clip & Tube Readers, Insight Eyeworks, circa Oct. 2001, 2 pages.

*Primary Examiner*—Sarah Purol
(74) *Attorney, Agent, or Firm*—Workman Nydegger

(57) ABSTRACT

Methods and apparatuses for an eyeglass case and display are provided. According to one aspect of the present invention, an eyeglass case permitting a consumer to view at least a portion of the eyeglasses is provided. In one embodiment, the eyeglass case is configured to permit a consumer to view the entire eyeglass frame. According to another embodiment, the eyeglass case provides a substantially flat surface permitting the eyeglass case to be rested on its end. According to another aspect of the present a method of and apparatus of displaying eyeglasses that includes a display member that permits a plurality of eyeglasses to be positioned one behind another such that each of the plurality of eyeglasses can be seen without needing to reposition the eyeglasses.

11 Claims, 6 Drawing Sheets

U.S. PATENT DOCUMENTS

| | | | | | |
|---|---|---|---|---|---|
| 4,733,775 | A | * | 3/1988 | Fireman | 206/5 |
| 4,744,461 | A | * | 5/1988 | Lapham | 206/5 |
| 5,141,117 | A | | 8/1992 | Olsen et al. | |
| D339,913 | S | | 10/1993 | Reed | |
| 5,423,419 | A | * | 6/1995 | Wentz et al. | 206/6 |
| 5,501,321 | A | | 3/1996 | Liu | |
| D369,466 | S | | 5/1996 | Jannard et al. | |
| 5,568,872 | A | * | 10/1996 | Hinnant, Sr. | 211/85.1 |
| D400,009 | S | | 10/1998 | Conway | |
| 5,899,371 | A | | 5/1999 | Weliver | |
| 5,949,515 | A | | 9/1999 | Hoshino | |
| D422,139 | S | | 4/2000 | Meikle | |
| D425,299 | S | | 5/2000 | Charbonneau | |
| 6,102,541 | A | | 8/2000 | Kuo | |
| D432,784 | S | | 10/2000 | Conway | |
| D432,786 | S | | 10/2000 | Rogers | |
| D434,560 | S | | 12/2000 | Chao | |
| D436,434 | S | | 1/2001 | Conway | |
| D436,725 | S | | 1/2001 | Rogers | |
| 6,170,651 | B1 | | 1/2001 | Taormina | |
| D437,112 | S | | 2/2001 | Toffoli | |
| 6,206,217 | B1 | | 3/2001 | Chiang | |
| D439,738 | S | | 4/2001 | McCormack | |
| D441,953 | S | | 5/2001 | Ben Moshe | |
| D446,389 | S | | 8/2001 | Zhou | |
| 6,273,246 | B1 | | 8/2001 | Marciano | |
| D454,686 | S | | 3/2002 | McCormack | |
| 6,382,407 | B1 | | 5/2002 | Chao | |
| 6,415,915 | B1 | * | 7/2002 | Grossman | 206/6 |
| D467,421 | S | | 12/2002 | Chao | |
| 6,491,158 | B2 | | 12/2002 | Chen | |
| 6,626,287 | B1 | * | 9/2003 | Watson | 206/6 |
| D483,944 | S | | 12/2003 | Conner | |
| 6,851,552 | B1 | | 2/2005 | Chao | |
| 6,929,116 | B2 | * | 8/2005 | Chao et al. | 206/5 |
| 2002/0157968 | A1 | | 10/2002 | Chen | |
| 2003/0111361 | A1 | | 6/2003 | Fischer et al. | |
| 2005/0155872 | A1 | | 7/2005 | Cheng | |

* cited by examiner

EYEWEAR CASE AND DISPLAY METHOD

CROSS-REFERENCE TO RELATED APPLICATIONS

This is a utility application of U.S. Provisional Patent Application Ser. No. 60/433,724 entitled "Eyewear Case and Display Methods" filed Dec. 13, 2002.

BACKGROUND OF THE INVENTION

1. The Field of the Invention

The present invention relates to eyeglass cases and displays. More particularly, the present invention relates to methods and apparatuses of eyeglass cases and displays.

2. The Relevant Technology

Eyeglass cases and point of sale displays have been used for many years to protect eyeglasses and to display eyeglasses to prospective buyers. The configuration of eyeglasses makes them difficult to display. Eyeglasses positioned on a flat surface can quickly become disorganized, damaged, or intertwined with frames of adjacent eyeglasses.

Eyeglass displays facilitate display of eyeglasses by presenting frames in a more organized and efficient manner. However, the configurations of typical displays have many deficiencies. The configuration of typical displays makes it difficult to remove and replace eyeglasses without dropping the eyeglasses or disturbing or damaging adjacent eyeglasses. Where the display can be rotated, eyeglasses can slip from the display and fall to the floor during movement of the display. Additionally, eyeglass displays can be expensive to manufacture and are often configured to display a limited number of eyeglasses on a large display.

Eyeglass cases are adapted to provide protection for eyeglasses. One drawback of typical eyeglass cases is that they are often opaque and prevent viewing of the frames without removing the eyeglasses from the eyeglass case. In many instances, the eyeglasses are removed from the eyeglass cases for display on point of sale displays. This increases the likelihood of damage to the eyeglass frames and lenses. Additionally, the cases are often discarded or misplaced resulting in inefficiencies due to wasted eyeglass cases, mismatched eyeglass cases and frames, or lost time spent locating the proper cases for the eyeglasses. Where an eyeglass case is used which is not matched to the eyeglasses, the chance of damaging or losing, the eyeglasses increases.

Some eyeglass cases have been developed to permit a consumer to be able to see part of the eyeglasses without needing to remove the eyeglasses from the case. Such eyeglass cases allow the eyeglasses to remain positioned in the eyeglass cases during display of the eyeglasses. However, such eyeglass cases suffer from several deficiencies. Eyeglass cases that have been developed to allow a consumer to view a portion of the eyeglasses typically are difficult to open, are tailored for a particular display type, and/or do not allow a consumer to view the entire eyeglass frame. Such eyeglass cases are typically disposable in nature and are of little usefulness once the eyeglasses have been purchased.

BRIEF SUMMARY OF THE INVENTION

The present invention relates to methods and apparatuses of eyeglass cases and displays. An eyeglass case is provided according to one aspect of the present invention. The eyeglass case is adapted to enclose a pair of eyeglasses while permitting a consumer to view at least a portion of the eyeglasses. According to one aspect of the present invention, the eyeglass case is configured to permit a consumer to view the entire eyeglass frame. In one embodiment, the eyeglass cases can be transparent, semi-transparent, or translucent to allow a consumer to view the color, style, and other aspects of the eyeglass frames. In another embodiment, the eyeglass case is reusable.

According to another aspect of the present invention, the eyeglass case provides a substantially flat surface permitting the eyeglass case to be rested on its end. By permitting the eyeglass cases to be rested on its end, the eyeglasses can be displayed in a vertical manner. This allows a large number of eyeglasses to be positioned adjacent one another in a small amount of display space. By permitting a consumer to view at least a portion of the eyeglasses, the eyeglass case allows the consumer to browse a large number of eyeglasses without having to remove the eyeglasses from the eyeglass cases. This improves the ease and efficiency of browsing eyeglasses.

The present invention also provides a display and method for displaying eyeglasses. According to one aspect of the present invention, the display includes a display member that permits a plurality of eyeglasses to be positioned one behind another such that each of the plurality of eyeglasses can be seen without needing to reposition the eyeglasses. In one embodiment, the display member includes a plurality of openings that are configured to receive an end of an eyeglass case such that each eyeglass case can be displayed in a vertical manner. In an alternative embodiment, the display member comprises a horizontally positioned shelf or tray that is configured to accommodate a plurality of vertically positioned eyeglass cases.

The combination of the display and the eyeglass case facilitates simple and efficient browsing of the eyeglasses. Additionally, the combination helps the eyeglasses stay neat and clean thus maintaining the organized and professional presentation of the eyeglasses. For example, the eyeglass cases allow a consumer to quickly identify the color, eyeglass frame style, and lens color of eyeglasses without needing to remove the eyeglasses from the eyeglass case. The configuration of the display allows a consumer to view a large number of eyeglass cases simultaneously without needing to move or reposition the eyeglass cases. Once a desired pair of eyeglasses is identified, the display permits the consumer to remove and replace the eyeglass case in which the eyeglasses are enclosed without disturbing adjacent eyeglass cases. Additionally, the configuration of the display allows the consumer to return the eyeglass case to the display without affecting the organized and professional presentation of the eyeglasses. The configuration further allows a user to rotate the eyeglass display without throwing the eyeglasses to the floor.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The present invention relates to methods and apparatuses of eyeglass cases and displays. According to one aspect of the present invention, an eyeglass case is provided which is adapted to enclose a pair of eyeglasses while permitting a consumer to view at least a portion of the eyeglasses. In one embodiment, the eyeglass case is configured to permit a consumer to view the entire eyeglass frame. According to another embodiment, the eyeglass case provides a substantially flat surface permitting the eyeglass case to be rested on its end. In this manner, the eyeglass case can be displayed in a vertical manner. This allows a consumer to view at least a portion of a large number of eyeglasses without having to remove the eyeglasses from the eyeglass case According to another aspect of the present invention a display and method for displaying eyeglass is provided. According to one aspect of the present invention, the display includes a display member that permits a plurality of eyeglasses to be positioned one behind another such that each of the plurality of eyeglasses can be seen without needing to reposition the eyeglasses.

According to another aspect of the present invention, the combination of the display and the eyeglass case facilitates simple and efficient browsing of the eyeglasses. Additionally, the combination maintains an organized and professional presentation of the eyeglasses. For example, the configuration of the display allows a consumer to view a large number of eyeglasses simultaneously without needing to move or reposition the eyeglass cases. Once a desired pair of eyeglasses is identified, the display permits the consumer to remove and replace the eyeglass case without disturbing adjacent eyeglass cases. Additionally, the configuration of the display allows the consumer to return the eyeglass case to the display without affecting the organized and professional presentation of the eyeglasses.

Figure 1:
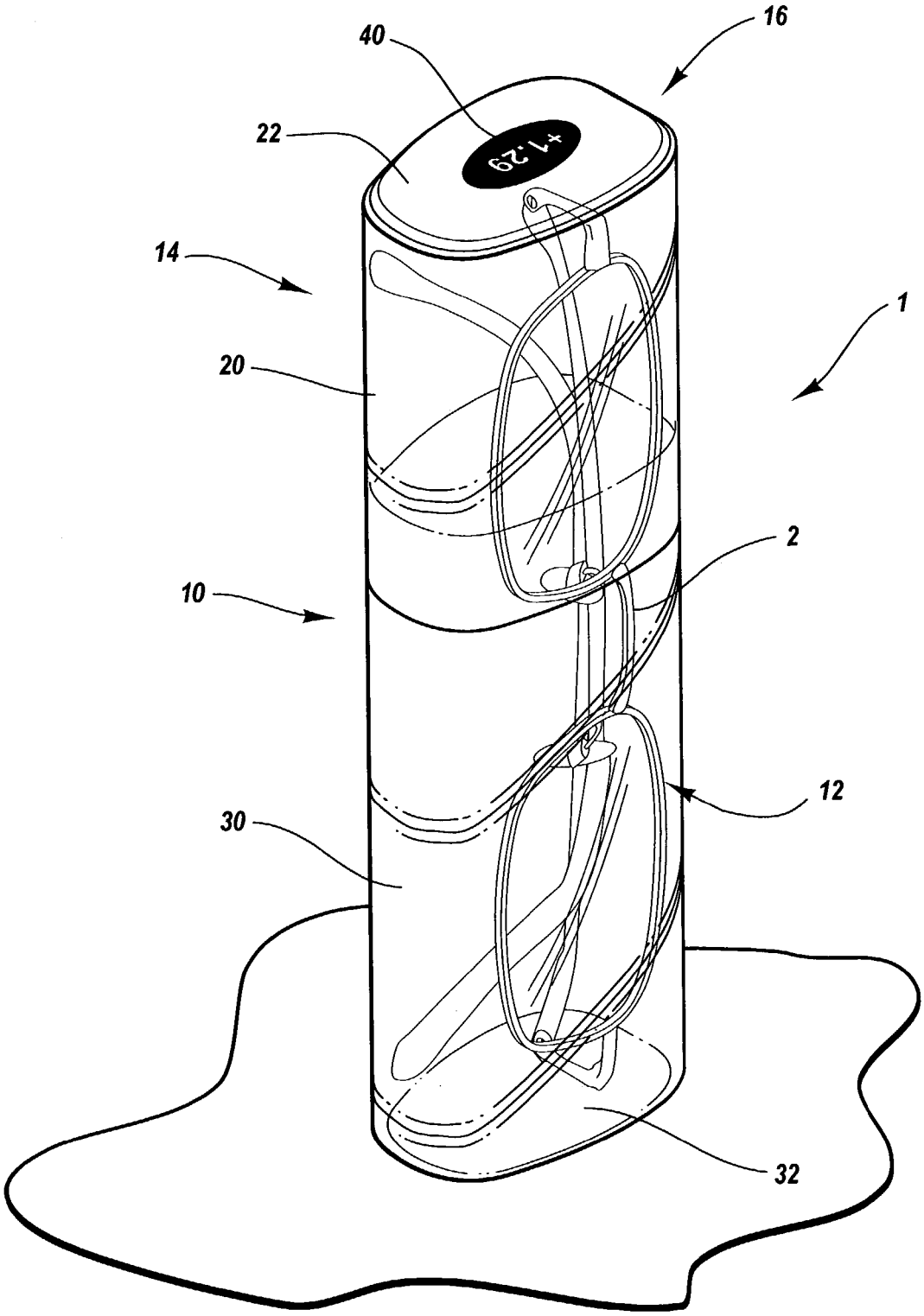
FIG. 1 illustrates a perspective view of an eyeglass case according to one aspect of the present invention.

With reference now to FIG. 1, there is shown an eyeglass case 1 and a pair of eyeglasses 2 positioned therein. Eyeglass case 1 provides a protective covering to eyeglasses 2 while allowing a consumer to observe part or all of the eyeglasses. In the illustrated embodiment, eyeglass case 1 comprises a body 10. Body 10 is adapted to enclose a pair of eyeglasses. Body 10 permits a consumer to observe at least a portion of eyeglasses 2. While eyeglass case 1 is described with reference to eyeglasses 2, it will be appreciated that eyeglasses 2 are representative of a variety of types and configurations of eyewear including but not limited to reading glasses, sunglasses, and computer glasses.

In the illustrated embodiment, body 10 is substantially transparent allowing a consumer to observe the color and frame style of eyeglasses positioned in the eyeglass case 1. In alternative embodiment, the body is translucent and permits a consumer to detect the color and/or outline of the eyeglasses positioned therein. In yet another embodiment, the eyeglass case includes a first translucent or transparent portion and a second opaque portion. The transparent or translucent portion permits a consumer to observe at least a portion of the eyeglasses.

In the illustrated embodiment, body 10 includes a first side surface 12, a second side surface 14, and a third side surface 16. First and second side surfaces 12, 14 are wider than third side surface 16. The width of first and second side surfaces 12, 14 roughly corresponds with the width of the eyeglasses from the top of the lens to the tips of the temple cover when the eyeglasses are in a folded position. The width of third side surface 16 roughly corresponds with the width of the folded eyeglasses at the thickest point from the back of the temples to the front of the lenses. When eyeglass case 1 is resting on first side surface 12, the front of the eyeglass lenses are facing downwards. When eyeglass case 1 is resting on second side surface 14 the front of the eyeglass lenses are facing upwards. When eyeglass case 1 is resting on third side surface 16 the eyeglass lenses are positioned in the same manner as when worn by a consumer.

In one embodiment, the three-side configuration of body 10 provides a tailored enclosure for accommodating the folded eyeglass frames. Typically, folded eyeglasses are widest at or near the top of the eyeglasses where the temples are folded behind the lenses. The eyeglasses are narrowest at the bottom portion of the eyeglasses where the temple tips touch the frame at the bottom of the lenses. The portion of the eyeglass case corresponding with the third side surface 16 accommodates the wider top of the eyeglasses. The narrower portion of the eyeglass case opposite the third side surface 16 accommodates the narrower bottom of the eyeglasses. As will be appreciated by those skilled in the art the configuration of body 10 is not limited to the embodiment illustrated in FIGS. 1 and 2. A variety of types and configurations of body 10 can be provided. For example, in one embodiment body 10 has a two-sided configuration. In another embodiment, body has a rectangular or any shape permitting the eyeglasses to be displayed on its side. In an alternative embodiment, body 10 does not provide a tailored enclosure for the eyeglass frames.

In the illustrated embodiment, body 10 comprises a first component 20 and a second component 30. First component 20 is configured to enclose the right side of eyeglasses 2. Second component 30 is configured to enclose the left side of eyeglasses 2. To form body 10, first component 20 and second component 30 are coupled to one another. In the illustrated embodiment, the three side surface configuration of body 10 provides an orientation for correct coupling of first component 20 to second component 30.

In the illustrated embodiment, first component 20 includes an end 22 while second component 30 includes an end 32. End 22 and end 32 comprise the top and bottom surfaces of eyeglass case 1. End 22 and/or end 32 provide a substantially flat surface permitting the eyeglass case to be rested on its end and displayed in a vertical manner. By permitting eyeglasses to displayed in a vertical manner, a plurality of eyeglass cases can be positioned so as to allow a consumer to view the eyeglasses in an efficient and organized manner.

In the illustrated embodiment, there is also shown indicia 40 situated on end 22 of first component 20. In the illustrated embodiment, indicia 40 provides an indication of the characteristics of the eyeglasses and other information related to the eyeglasses contained therein. For example, in the illustrated embodiment indicia 40 specifies the magnification power of the eyeglass lenses. In alternative embodiments, the indicia can include, but is not limited to, eyeglass style, price, UPC code, SKU number, picture of eyeglass style, style number, and/or care information. It will be appreciated by those skilled in the art that a variety of types and configurations of eyeglass cases can be utilized without departing from the scope and spirit of the present invention. For example, in one embodiment, body 10 has a rectangular configuration with four side surfaces. In an alternative embodiment, one of the first or second ends is weighted to maintain the eyeglass case in a vertical display position.

Figure 2:
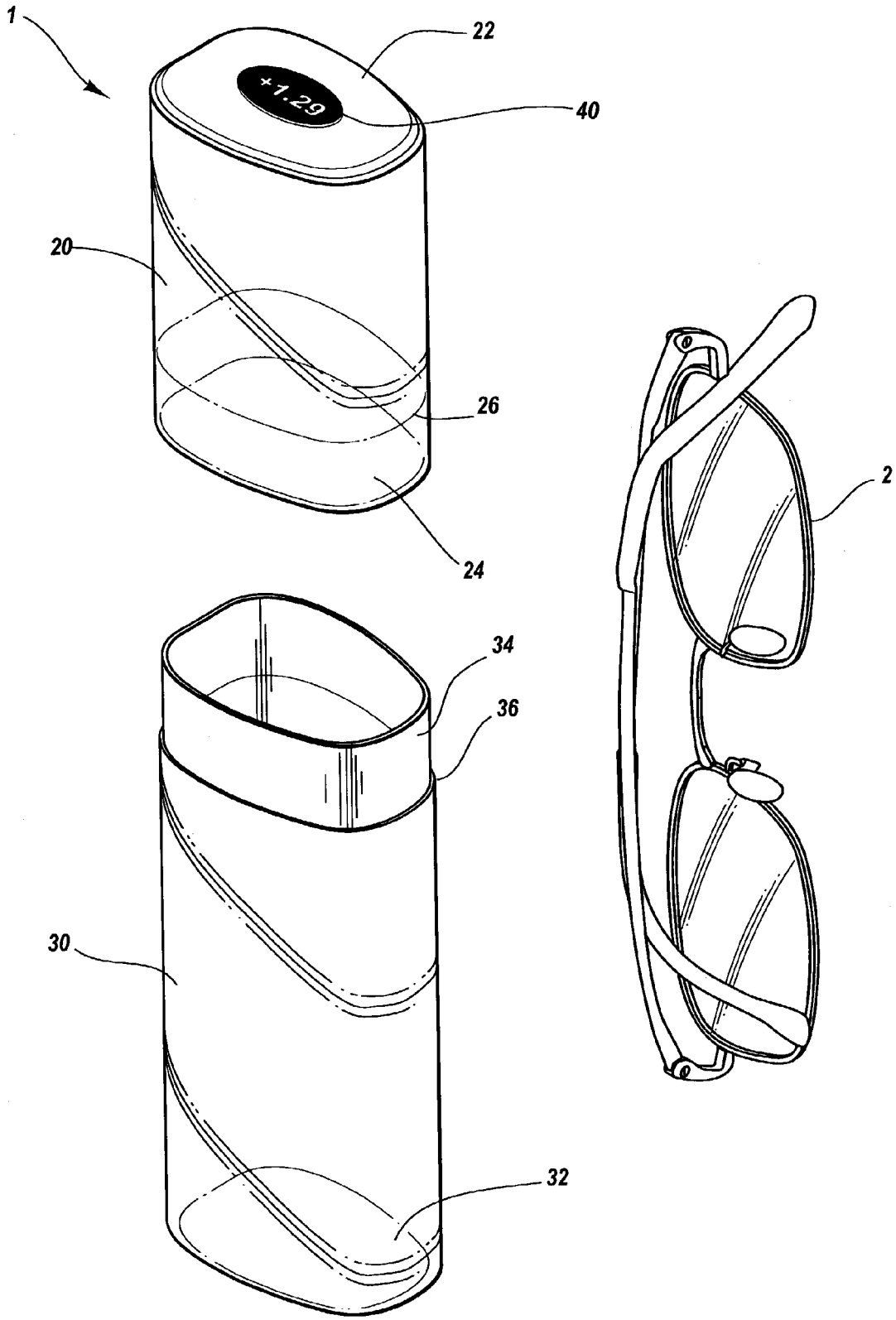
FIG. 2 shows a perspective view of an eyeglass case illustrating a mechanism for coupling the first end of the eyeglass case to the second end of the eyeglass case.

With reference now to FIG. 2, there is shown a perspective view of eyeglass case 1 illustrating a mechanism for coupling first component 20 to second component 30. First component 20 is shown separated from second component 30. Additionally, eyeglasses 2 have been removed from eyeglass case 1. First component 20 comprises an end 22, a recess 24, and a flange 26. Second component 30 comprises an end 32, an insert 34, and a flange 36.

Recess 24 of first component 20 comprises a female element. Insert 34 of second component 30 comprises a male element. Insert 34 is adapted to be positioned in recess 24 to secure first component 20 to second component 30. Flange 26 of first component 20 abuts the end of insert 34 when insert 34 is properly positioned in recess 24. Similarly flange 36 abuts the end of first component 20 when insert 34 is properly positioned in recess 24. In this manner, a simple yet effective coupling is provided between first component 20 and second component 30.

As will be appreciated by those skilled in the art, a variety of types and configurations of coupling can be provided between first component 20 and second component 30 without departing from the scope and spirit of the present invention. For example, in one embodiment a threaded coupling is provided between first component 20 and second component 30. In an alternative embodiment, a hinged coupling is provided between first component 20 and second component 30.

Figure 3:
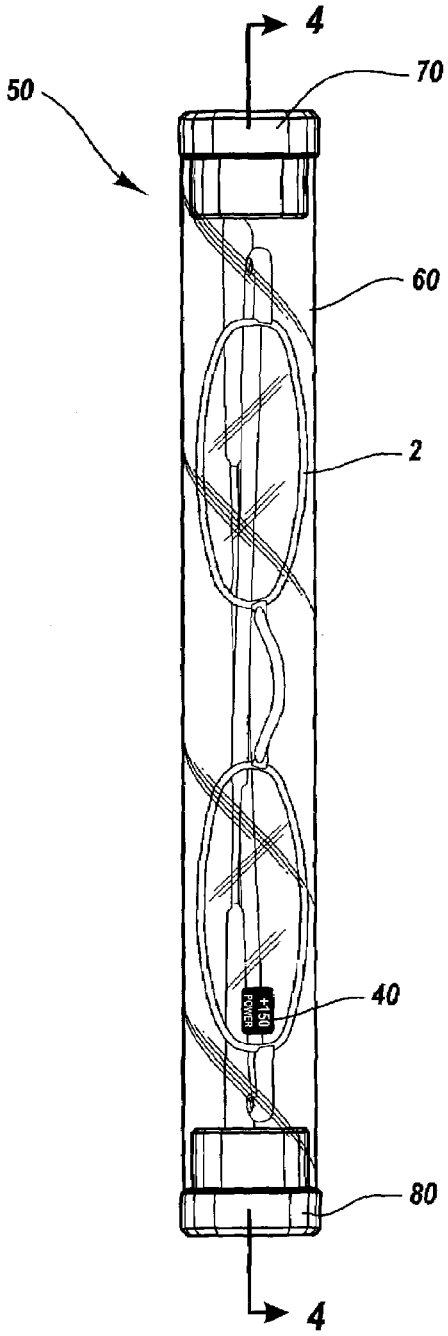
FIG. 3 shows a front view of an eyeglass case according to another aspect of the present invention.

With reference now to FIG. 3, there is shown an eyeglass case 50 according to an alternative embodiment of the present invention. In the illustrated embodiment, eyeglass case 50 is adapted to enclose a pair of eyeglasses while permitting a consumer to observe at least a portion of the eyeglasses. Eyeglass case 50 comprises a body 60, a first end 70, and a second end 80.

Body 60 is adapted to enclose eyeglasses 2, while permitting a consumer to observe at least a portion of the eyeglasses 2. Body 60 permits a consumer to observe at least a portion of the eyeglasses by having a transparent, semi-transparent, or translucent construction. In the illustrated embodiment body 60 has a cylindrical configuration. In an alternative embodiment, body 60 has a rectangular or triangular configuration.

First end 70 is coupled to one end of body 60. Second end 80 is coupled to the opposite end of body 60. In the illustrated embodiment, first end 70 and second end 80 comprise removable barriers maintaining the position of eyeglasses 2 in eyeglass case 50. At least one of the first and second ends 70 and 80 provides a substantially flat surface permitting the eyeglass case to be rested on its end.

Figure 4:
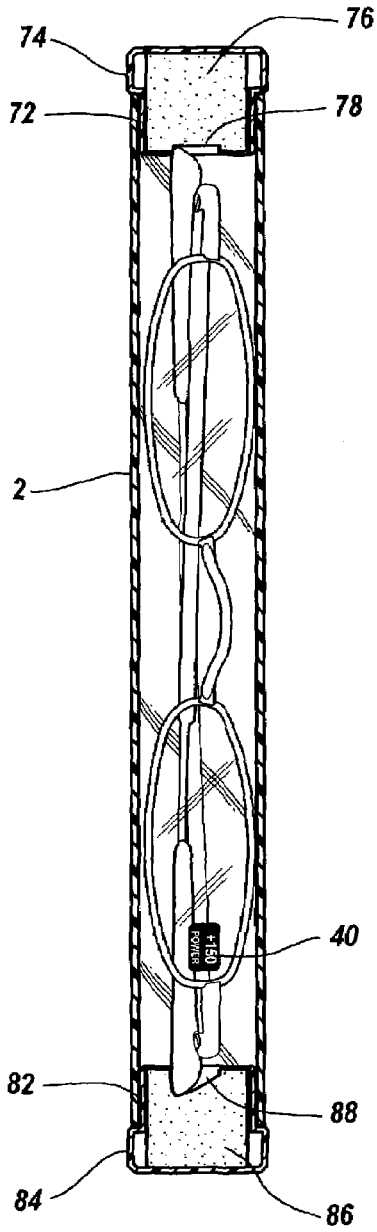
FIG. 4 illustrates a cross-sectional view of an eyeglass case illustrating the construction of the eyeglass case according to one aspect of the present invention.

With reference now to FIG. 4, there is shown a cross-sectional view taken along lines 4—4 of FIG. 3 illustrating the construction of eyeglass case 50. In the illustrated embodiment, body 60 is constructed of a clear synthetic polymer. By utilizing a polymer material, body 60 provides shatterproof protection for eyeglasses that can be manufactured simply and at low cost. It will be understood by those skilled in the art that body 60 can be constructed from a variety of types and configurations of materials. For example, in one embodiment, body 60 comprises a glass tube.

First end 70 and second end 80 are inserted into the ends of body 60. First end comprises an insert 72, an end cap 74, a resilient material 76, and a contact region 78. Insert 72 is positioned internal to one end of body 60. End cap 74 is positioned external to the end of body 60. End cap 74 provides a stopping mechanism for preventing insertion of first end 70 past a given point. Resilient material 76 provides a cushion mechanism internal to first end 70. Contact region 78 permits a portion of the eyeglasses to contact resilient material 76, thus minimizing movement of eyeglasses 2 within eyeglass case 50.

Second end 80 comprises an insert 82, an end cap 84, a resilient material 86, and a contact region 88. Insert 82 is positioned internal to the other end of body 60. End cap 84 is positioned external to the end of body 60 and provides a stopping mechanism for preventing insertion of second end 80 past a given point. Resilient material 86 provides a cushion mechanism internal to second end 80. Contact region 88 permits a portion of the eyeglasses to contact resilient material 86, thus minimizing movement of eyeglasses 2 within eyeglass case 50.

In the illustrated embodiment, indicia 40 is positioned directly on eyeglasses 2. By permitting a consumer to observe at least a portion of eyeglasses 2, the configuration of body 60 allows a consumer to view indicia 40 so as to identify characteristics of the eyeglass quickly and easily. A variety of types and configurations of eyeglass cases can be utilized without departing from the scope and spirit of the present invention. For example, in the preferred embodiment the eyeglass case is reusable thus providing a mechanism for displaying the eyeglasses to a consumer and for protecting the eyeglasses on an ongoing basis subsequent to purchase of the eyeglasses. In another embodiment, the eyeglass case includes a display element that permits the eyeglass case to be hung in a vertical manner. Examples of display elements include a hook, loop, tag, adhesive tab, and the like.

Figure 5:
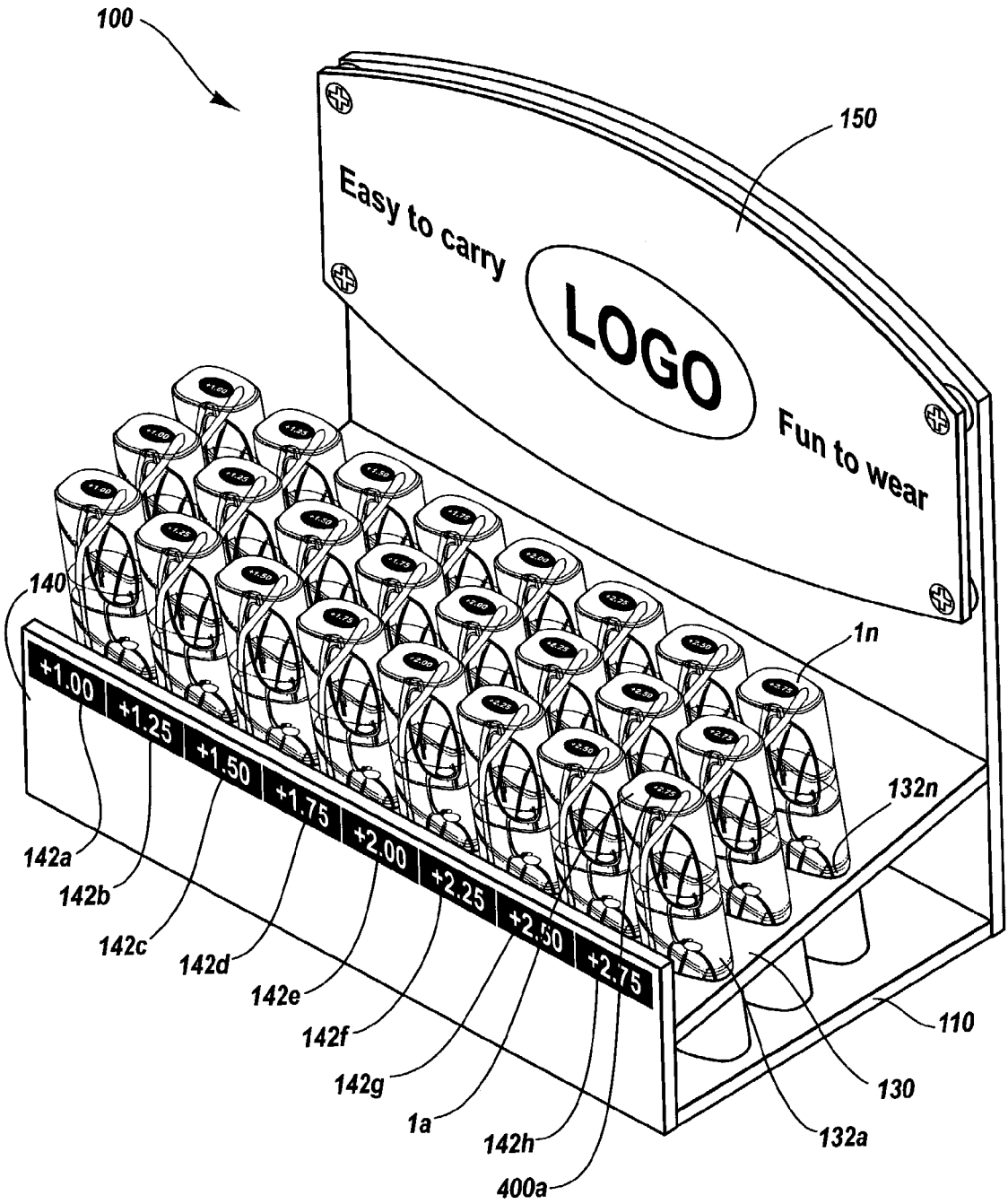
FIG. 5 illustrates a perspective view of a display for displaying eyeglasses on a shelf or table top according to one aspect of the present invention.

With reference now to FIG. 5 there is shown a display 100 for displaying eyeglasses. Display 100 permits a plurality of eyeglasses to be positioned one behind 2 another such that a plurality of eyeglasses can be seen without needing to reposition the eyeglasses. Additionally, the configuration of display 100 permits eyeglasses to be displayed in a vertical manner, thus providing an improved and efficient browsing experience.

In the illustrated embodiment, display 100 comprises a base 110, a support structure 120, a display member 130, a front 140, and a display surface 150. Base 110 provides a mechanism for securing display 100. Base 110 allows a consumer to position display 100 on a surface such as a floor, a counter top, or shelf, thus permitting a consumer to identify and browse eyeglasses to be purchased.

Support structure 120 is coupled to base 110. Support structure 120 provides a frame for securing other components of display 100. Display member 130 is coupled to support structure 120 and/or base 110. Display member 130 permits a plurality of eyeglasses to be positioned in rows one behind another such that each of the plurality of eyeglasses can be seen without needing to reposition the eyeglasses. This increases the number of eyeglasses that can be displayed. Additionally, display member 130 permits the eyeglasses to be displayed in a vertical manner.

In the illustrated embodiment, display member 130 is positioned at an angle to facilitate viewing of consecutive rows of eyeglasses. In an alternative embodiment, display member 130 is positioned in a substantially horizontal manner. A variety of types and configurations of display members can be utilized without departing from the scope and spirit of the present invention. In one embodiment, display member 130 comprises a shelf on which eyeglass cases can be positioned in a vertical manner. In another embodiment, display member 130 comprises a tray adapted to allow proper positioning of the eyeglasses.

In the illustrated embodiment, display member 130 includes a plurality of openings 132*a–n*. Openings 132*a–n* are configured to receive an end of eyeglasses cases 1*a*–1*n* such that the eyeglass cases are displayed in a vertical manner. Each one of openings 132*a–n* corresponds with a slot that accommodates the eyeglass case. The slot secures the eyeglass case such that the eyeglass case is displayed in a vertical manner. The slot is configured to conform to the shape of the eyeglass cases. In an alternative embodiment, openings 132*a–n* do not correspond with slots. Instead, the configuration of the openings 132*a–n* is sufficient to secure the eyeglass cases.

The configuration of display member 130 and openings 132*a–n* facilitates viewing of the eyeglasses when a purchaser is attempting to select from a variety of eyeglasses. A purchaser can quickly identify the characteristics of eyeglasses such as color, frame design, and magnification. This permits a purchaser to quickly identify desirable eyeglasses which can be inspected in greater detail.

Once a number of eyeglasses of interest have been identified, display member 130 and openings 132*a–n* allow a consumer to easily and efficiently remove the eyeglass cases from the display. The configuration of openings 132*a–n* prevents disruption of adjacent eyeglasses when removing or replacing eyeglass covers. This also permits a consumer to return the eyeglass case to its proper position in the display without difficulty and without disturbing adjacent eyeglasses, thus maintaining the organized and efficient display of eyeglasses.

In the illustrated embodiment, display 100 includes a front 140 having a plurality of indicia 142*a–h*. Indicia 142*a–h* correspond with characteristics of the eyeglasses such as magnification of each row of eyeglasses. In this manner a consumer can quickly and efficiently identify rows of eyeglasses having a desired magnification. Once a given magnification is identified, the consumer can select glasses according to other characteristics, such as frame type, color, or tinting of the lenses. The configuration of eyeglass cases 1*a*–1*n* further facilitates the efficiency and ease of browsing eyeglass by permitting a consumer to view important characteristics of the eyeglasses without needing to remove the eyeglasses from the display 100.

In the illustrated embodiment, display 100 also includes display surface 150. Display surface 150 is configured to provide a mechanism for display of an emblem, logo, advertisement, or informational materials to a consumer. As will be appreciated by those skilled in the art, the configuration and placement of the display surface can be varied without departing from the scope and spirit of the present invention.

Figure 6:
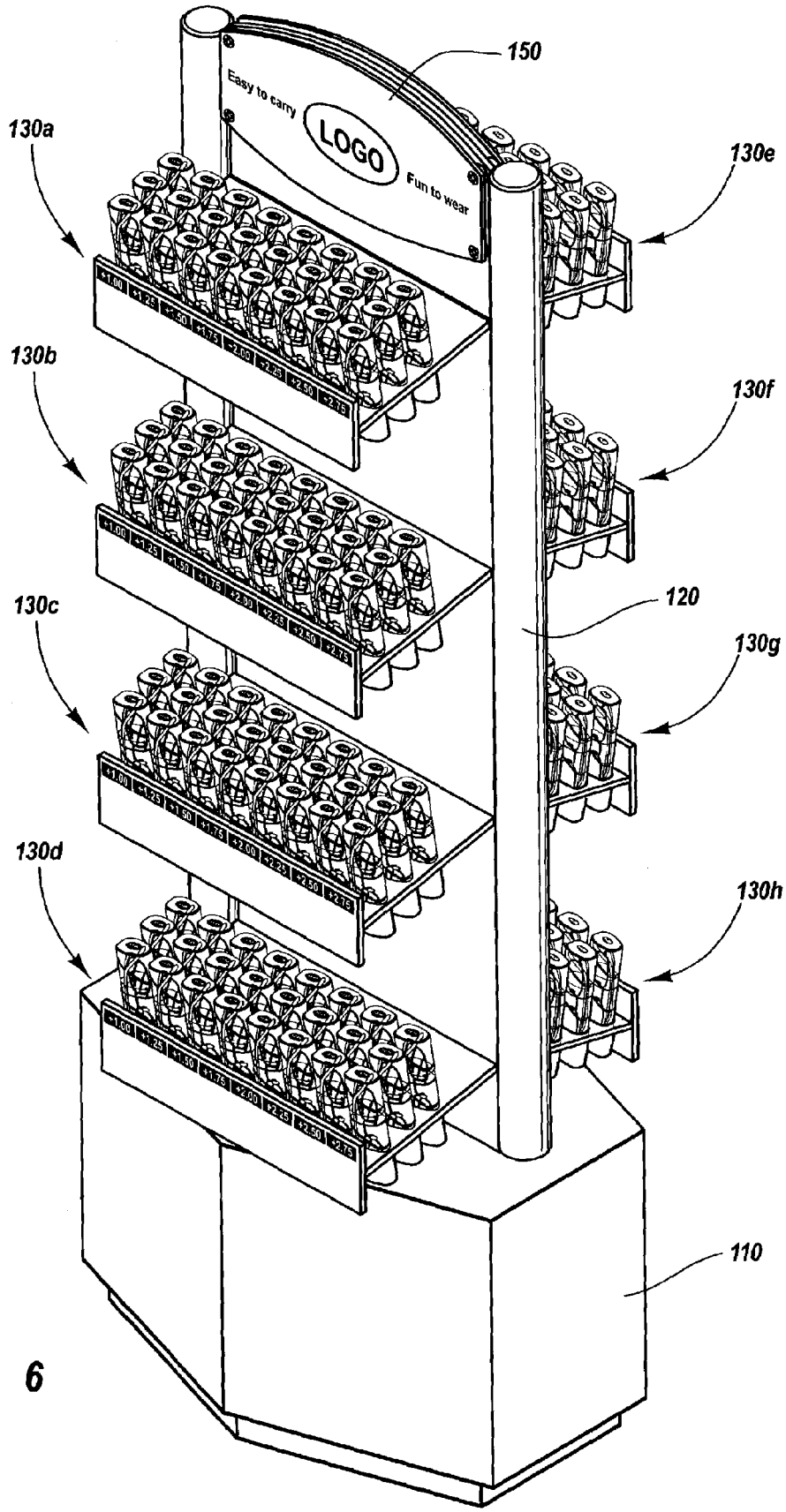
FIG. 6 illustrates a perspective view of a display for use on a show room floor according to one aspect of the present invention.

With reference now to FIG. 6 there is shown an alternative embodiment of display 100. In the illustrated embodiment display 100 comprises a base 110, a support structure 120, display members 130*a–h*, and a display surface 150. Base 110 secures the display while providing aesthetic and functional design features to the display. The height of base 110 facilitates display of eyeglasses by positioning the lowest display members within a consumer's reach.

Support structure 120 is coupled to base 110. Support structure 120 provides a central frame mechanism to which display members 130*a–h* are coupled. Display members 130*a–d* are positioned on one side of support structure 120. Display members 130*e–h* are positioned on the opposite side of support structure 120. By providing a plurality of display members, a variety of types and configurations of eyeglasses can be provided. For example, a wide range of lens powers and different colors and intensities of lens shading of can be provided. Additionally, frames having different styles, colors, and construction can be displayed.

Figure 7:
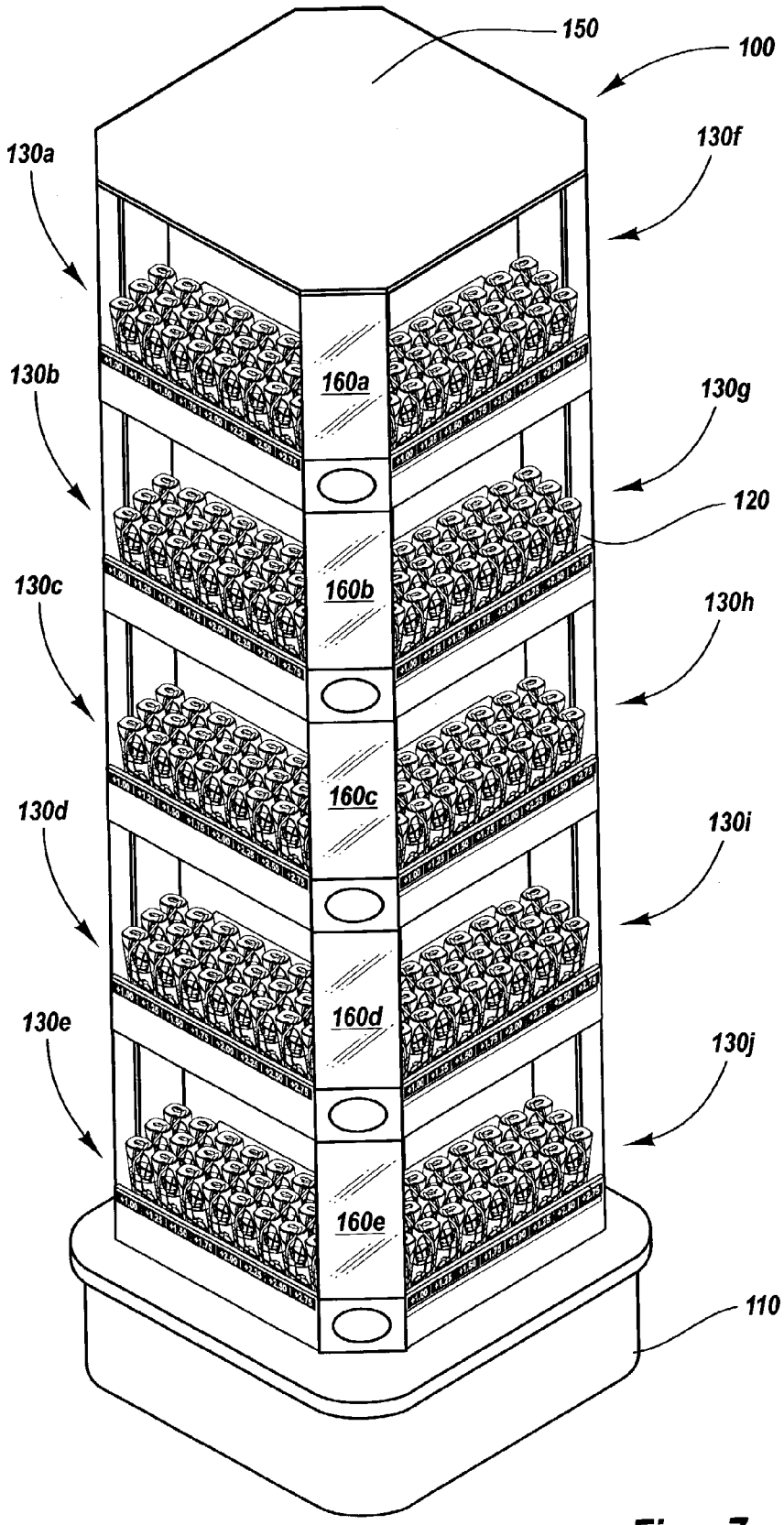
FIG. 7 illustrates a perspective view of a display according to one aspect of the present invention.

With reference now to FIG. 7, there is shown yet another embodiment of display 100 according to one aspect of the present invention. In the illustrated embodiment display 100 has a rectangular configuration. Base 110 comprises a wide and solid foundation for display 100. Support structure 120 has a skeleton frame configuration to provide support to five display members on each of four sides of the display. Additionally, reflective surfaces 160*a–e* are provided. Reflective surfaces 160*a–e* provide a mechanism for allowing consumers to observe their visage while wearing the selected eyeglasses.

As will be appreciated by those skilled in the art, a variety of types and configurations of displays can be utilized without departing from the scope or spirit of the present invention. For example, in one embodiment the display has three sides instead of four sides as shown in FIG. 7. In another embodiment, the support structure is integrally coupled to the display member. In yet another embodiment, the display is rotatable about a central axis. In an alternative embodiment the display is disposable. In yet another embodiment, the display is configured to permit a plurality of substantially clear eyeglass cases to be hung such that the eyeglasses are displayed vertically.

One presently preferred method of displaying eyeglasses enclosed in eyeglass cases will now be described in relation to FIGS. 1–7. A display 100 having one or more display members 130 for containing glasses is provided. Next, a first eyeglass case containing a pair of eyeglasses is positioned on display member 130. Next, at least a second eyeglass case containing a pair of eyeglasses is positioned on the display member 130 behind the first eyeglass case such that a consumer can view the eyeglasses in the first and second eyeglass case simultaneously.

Another presently preferred method of displaying the eyeglasses will now be described. In the embodiment, a display having at least a first display member is provided. Next, a first eyeglass case permitting a user to view an entire frame of eyeglasses and containing a pair of eyeglasses is hung on the display member such that the eyeglasses are positioned vertically. Next, a. second eyeglass case permitting a user to view an entire frame of eyeglasses and containing a pair of eyeglasses is hung on the display member behind the first eyeglass case such that the eyeglasses are positioned vertically.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An eyeglass display comprising:

a support member;

one or more display members having a plurality of openings, wherein each of said plurality of openings is adapted to receive an eyeglass case and is configured to permit a consumer to view at least a portion of the eyeglasses enclosed therein, wherein at least one eyeglass case is received by one of said plurality of openings and is displayed in a substantially vertical manner, said eyeglass case comprising, a body adapted to enclose a pair of eyeglasses, said body have a first component and a second component, said second component having a substantially flat surface at one end thereof, said body configured to permit a consumer to observe at least-a portion of the pair of eyeglasses enclosed within said body, wherein said substantially flat surface at said one end of said second component permitting said eyeglass case to be positioned on said substantially flat surface at said one end of said second component in a substantially vertical manner.

2. The eyeglass case of claim 1, wherein each of said plurality of openings corresponds with a slot configured to secure said eyeglass case in a substantially vertical manner.

3. The eyeglass case of claim 1, wherein each slot is configured to conform to the shape of said eyeglass case.

4. The eyeglass case of claim 1, wherein said display member is positioned at an angle to facilitate viewing of consecutive rows of eyeglasses.

5. The eyeglass case of claim 1, wherein said display further comprises at least a second display member.

6. An eyeglass display comprising:

a base;

a support structure coupled to said base; and one or more display members having a plurality of eyeglass cases positioned in a substantially vertical manner one behind another, wherein at least one of said plurality of eyeglass cases comprises, a body adapted to enclose a pair of eyeglasses, wherein said body is configured to permit a consumer to view the eyeglasses contained therein, said body comprising a first component and a second component coupled to said first component, wherein at least one of said first and second components is configured to permit said body to stand in a substantially vertical manner, wherein said plurality of eyeglass cases are positioned to allow each of the plurality of eyeglasses to be seen without requiring removal of at least one of said plurality of eyeglass cases from the display.

7. The eyeglass case recited in claim 6, wherein the first component and second component are removably coupled.

8. The eyeglass case recited in claim 6, wherein both of said first component and said second component have a substantially flat surface at the end thereof.

9. The eyeglass case recited in claim 6, wherein one of said first component and said second component have a substantially flat surface at the end thereof.

10. The eyeglass display recited in claim 6, wherein the display is configured for hanging.

11. The eyeglass display recited in claim 6, wherein said substantially vertical manner of displaying said eyeglass case comprises said eyeglass case being placed in a position equal to or greater than a forty-five degree angle and equal to or less than a ninety degree angle relative to the base of the display.

* * * * *

UNITED STATES PATENT AND TRADEMARK OFFICE

CERTIFICATE OF CORRECTION

PATENT NO. : 7,188,739 B1 
APPLICATION NO. : 10/360264
DATED : March 13, 2007
INVENTOR(S) : Raile It is certified that error appears in the above-identified patent and that said Letters Patent is hereby corrected as shown below:

Drawings

Sheet 4, replace Figure 5 with the figure depicted herein below, in which the "support structure" has been labeled with --120--

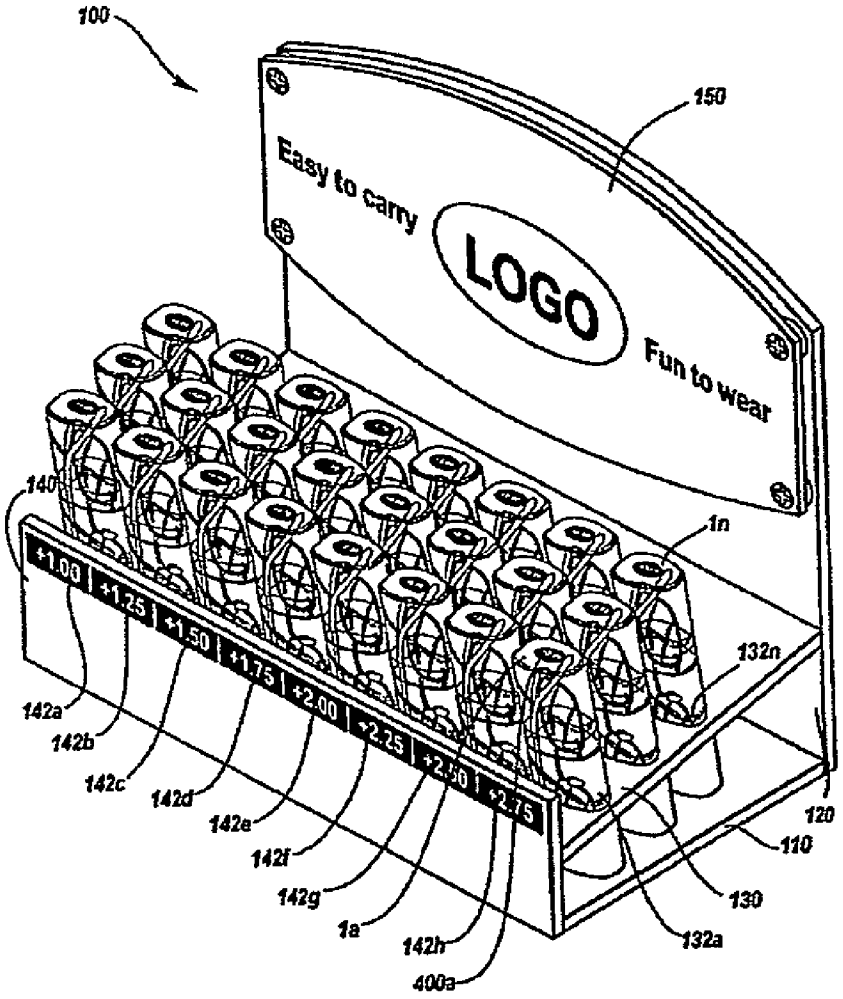

Fig. 5

Column 1

Line 46, after "losing" remove ","

Column 6

Line 52, remove "2"

UNITED STATES PATENT AND TRADEMARK OFFICE

CERTIFICATE OF CORRECTION

PATENT NO. : 7,188,739 B1
APPLICATION NO. : 10/360264
DATED : March 13, 2007
INVENTOR(S) : Raile It is certified that error appears in the above-identified patent and that said Letters Patent is hereby corrected as shown below:

Column 9
Line 19, after "comprising" change "," to --:--
Line 21, change "have" to --having--
Line 24, change "least-a" to --least a--
Line 31, change "case" to --display--
Line 34, change "case" to --display--
Line 36, change "case" to --display--
Line 39, change "case" to --display--

Column 10
Line 8, after "comprising" change "," to --:--

Signed and Sealed this

Thirty-first Day of July, 2007

JON W. DUDAS
*Director of the United States Patent and Trademark Office*